United States Patent [19]

Goudsmit

[11] 4,432,114

[45] Feb. 21, 1984

[54] DENTAL-CARE DEVICE AND BRUSH BODY SUITABLE THEREFOR

[76] Inventor: Johan H. Goudsmit, Rijnsburgerweg 48, 2333 AB Leiden, Netherlands

[21] Appl. No.: 412,581

[22] Filed: Aug. 27, 1982

Related U.S. Application Data

[63] Continuation-in-part of Ser. No. 81,921, Oct. 4, 1979, Pat. No. 4,346,493.

[30] Foreign Application Priority Data

Oct. 10, 1978 [NL] Netherlands ..... 7810204

[51] Int. Cl.[3] ..... B08B 1/00; A46B 904

[52] U.S. Cl. ..... 15/104.93; 15/167 R; 15/187; 15/DIG. 5; 424/49; 424/52; 426/104

[58] Field of Search ..... 15/186, 187, 188, 167 R, 15/167 A, 159 A, 104.92, 104.93, 104.94, DIG. 5; 424/52, 49, 55; 426/104, 132, 134, 420, 91

[56] References Cited

U.S. PATENT DOCUMENTS

| | | | |
|---|---|---|---|
| 2,140,294 | 12/1938 | Loeffler | 15/167 A |
| 2,778,045 | 1/1957 | Bly et al. | 15/167 R X |
| 3,070,102 | 12/1962 | MacDonald | 15/104.94 |
| 3,120,670 | 2/1964 | Amodeo | 15/159 R X |
| 3,151,028 | 9/1964 | Hay | 424/55 |
| 3,231,925 | 2/1966 | Conder | 15/104.94 |
| 3,378,870 | 4/1968 | Matsunaga | 15/104.94 |
| 3,613,143 | 10/1971 | Muhler et al. | 15/167 R |
| 3,853,412 | 12/1974 | Griffin | 15/104.93 |
| 3,959,842 | 6/1976 | Alley | 15/167 R |
| 4,157,386 | 6/1979 | LaRochelle | 424/52 |

FOREIGN PATENT DOCUMENTS

| | | | |
|---|---|---|---|
| 2648289 | 4/1978 | Fed. Rep. of Germany | 15/104.94 |
| 158341 | 10/1919 | United Kingdom | 15/167 R |
| 1091550 | 11/1967 | United Kingdom | 15/104.94 |

*Primary Examiner*—Peter Feldham

*Attorney, Agent, or Firm*—Irvin A. Lavine

[57] ABSTRACT

A dental care device for insertion within the mouth includes a flat, triangular support body, bristles extending from one side, and a pliable, resilient projection extending from the same side substantially parallel to the bristles. The projection is at a corner of the body and the bristles adjacent the projection are shorter than the projection, the height of the bristles increasing with distance from the projection.

20 Claims, 10 Drawing Figures

DENTAL-CARE DEVICE AND BRUSH BODY SUITABLE THEREFOR

CROSS REFERENCE TO RELATED APPLICATION

This application is a continuation-in-part of the copending application of Johan H. Goudsmit, Ser. No. 81,921, filed Oct. 4, 1979, for Dental-Care Device and Brush Body Suitable Therefor, now U.S. Pat. No. 4,346,493.

BACKGROUND OF THE INVENTION

This invention relates to a device for dental care which is placed entirely within the mouth and chewed.

It is well-known that brushing the teeth is essential for good oral hygiene, as this can remove bacterial plaque, which is responsible for dental decay and inflammation of the gums. Many types of tooth brushes are commerically available, which, when they are used properly, provide excellent dental care. Normal conventional toothbrushes provided with a palatable dentrifrice mass coating are also known.

U.S. Pat. No. 3,378,870 (Matsunaga) describes a conventional toothbrush having dry cleaning agent adhering to the bristles. The cleaning agent may comprise sweetening materials. British patent specification No. 1,091,550 (Watson et al) discloses a disposable toothbrush having a dried dentifrice coating on the head portion. The dentifrice may comprise sodium lauryl sulphonate, saccharine or other flavouring matter to choice.

German Offelegungsschrift No. 2,648,289 (Voss) describes a disposable toothbrush, the head of which is enveloped in a candy composition, which contains caries producing components, such as saccharose. The adverse effects thereof must be counteracted by using the brush further, after the candy composition has been consumed, by brushing with toothpaste. U.S. Pat. No. 3,120,670 (Amodeo) discloses a conventional toothbrush as well. To promote its use it contains odorific compounds or has a color reminiscent of edible goods, for example candy.

Unfortunately it is found, that, in spite of good instruction by, for example, dentists and oral hygienists, most people brush their teeth poorly with the conventional toothbrushes, that is to say, carelessly and too hastily, and with insufficient frequency. Examples of causes thereof are laziness, lack of time and lack of opportunity to brush the teeth (when travelling or at work).

There are known a few dental care devices for insertion entirely in the mouth, to be chewed upon, although they have no enveloping candy composition.

U.S. Pat. No. 3,231,925 (Conder) provides a spherical core with a plurality of individual bristles, which extend outwardly from the core on numerous axes, each of which substantially intersects the center of the spherical core; the whole is coated with a layer of toothpaste.

U.S. Pat. No. 3,853,412 (Griffin) describes a resilient plastic or rubber tooth cleaning ball with a plurality of groups of bristles along its outer periphery and a hollow interior filled with dentifrice. The dentifrice will be forced out through a plurality of openings in the ball body when the device is chewed upon. The patent further discloses modified devices having a bar-bell or rectangular configuration.

The chewable dental care devices of Conder and Griffin have some major drawbacks. Their brushing effect is slight as chewing on the devices only produces a flattening of the bristles. The bristle ends are not forced in the hidden places, in between the teeth, as is possible with conventional toothbrushing, in fact they even do not reach those places. As the bristles point in all directions they readily hurt tongue and cheeks and (at least) give an unpleasant feeling. Furthermore, the making of those devices by injection moulding is extremely difficult.

U.S. Pat. No. 2,140,294 (Loeffler) discloses a toothbrush in which the bristles extend in the direction of the handle, rather than perpendicularly to it.

French Patent specification No. 1,126,012 (Delaruelle) discloses a device for applying a medicinal paste to teeth and gums. It is made of flaccid material so that it may adapt itself to the shape of the space in the mouth between lips and teeth. The plate shaped languette is merely a member to hold the device in its place, and is not for chewing and cleaning the teeth; furthermore the device has no bristles.

U.S. Pat. No. 3,070,102 (MacDonald) discloses a throw-away toothbrush to be mainipulated not by means of a handle portion, but by means of a finger. For that purpose the backside of the brush body is provided with an adhesive with which it can be adhered to a finger.

U.S. Pat. No. 3,959,842 (Alley) discloses a tongue supported brush, to be placed on the tongue.

It is observed that dental care devices containing edible materials are known in the prior art. However, they do not contain a chewable brush.

U.S. Pat. No. 2,778,045 (Bly) discloses an edible palatable capsule in the form of a brittle shell containing dentifrice.

U.S. Pat. No. 4,147,386 (La Rochelle) discloses a soft chewable lozenge, which contains a starch adhesive and is dispersed in the mouth by the saliva to form a sticky coating on the teeth, which can be removed only by proper brushing. The object of this lozenge is to compel the user to brush his teeth more carefully.

U.S. Pat. No. 31,51,028 (Hay) discloses a sucking tablet stimulating the secretion of the saliva in the mouth.

SUMMARY OF THE INVENTION

The present invention is directed to a dental care device for insertion entirely within the mouth of a human, and includes a support body which is preferably substantially flat, but may have a stepped portion and grooves and ridges. Preferably, the support body is triangular in plan form, and the support body has bristles extending from a surface of it, the bristles have a triangular cross-sectional configuration and are extending substantially in the same direction, that is, they are parallel to each other. There is provided, in addition, a pliable and resilient projection which extends from the noted surface of the support body, preferably being located adjacent an edge of the support body and extending in the same direction as the bristles. Where the support body is triangular in plan form, or has a plan form with a corner, the projection extends from the corner, and where the support body has a stepped portion, that stepped portion underlies the noted corner from which the projection extends.

Preferably, the bristles which are adjacent the projection are of reduced height in comparison with the bristles remote from the projection, and the bristles increase in height substantially uniformly as the bristles to the projection increases, thereby providing and open wedge adjacent the projection. The bristles may comprise calcium carbonate or glass fibers, as abrading materials, or the bristle surfaces may be roughened. The projection may be hollow, with an opening provided thereinto, and may be filled with a suitable dentifrice material. The device may be partially or entirely coated with a non-caries producing candy.

DESCRIPTION OF THE PREFERRED EMBODIMENTS

One aspect of the present invention is the provision of a dental care device that makes the care of one's teeth a pleasant occupation, which is not tied down to time or place, so that a much larger number of people may be able to take proper care of their teeth than now is the case. Therefore the dental care device may comprise a chewable brush and a palatable mass of a non-caries producing candy and be dimensioned so that it is capable of being inserted entirely within the mouth of a human. The present invention makes possible a pleasant manner of taking care of the teeth, as it must be treated like a chewable sweet, chewing gum for instance. It is certainly surprising, that a combination of actions which are deemed contradictory, dental care on the one hand and eating sweets on the other, leads to an increase of the possibilities of caring for the teeth, and thereby to an improvement of dental care.

When the user chews the dental care device, according to the present invention, his teeth are thereby brushed and his gums massaged.

Figure 1:
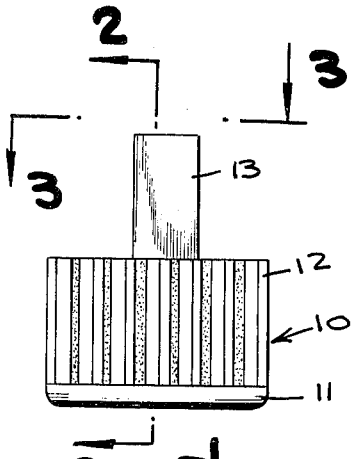
FIG. 1 is an elevational view of a dental care device.
Figure 2:
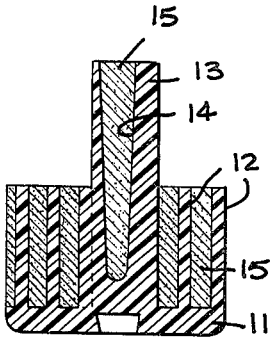
FIG. 2 is a cross-sectional view taken along the line 2—2 of FIG. 1.

Referring now to the drawings, there are shown embodiments of a dental care device, having certain characteristic features in common. The first embodiment, shown in FIGS. 1–3, comprises a dental care device 10 which includes a support body 11, bristles 12, and an upstanding projection 13 which extends in generally the same direction as the bristles 12 and from the same side of the generally flat body 11 as do the bristles 12. The material of which the support body 11, bristles 12 and projection 13 is made is pliable and resilient. As shown in FIGS. 1 and 2, the projection 13 extends to a greater height than do the bristles 12. FIG. 2 shows that the projection 13 is provided with a hollow 14 which extends thereinto from the outer end thereof, and material 15 may be contained in the hollow 14, such material to be hereinafter described. Further, as shown in FIG. 2, the space between the bristles 12 may be filled with the material 15, or the material 15 may be otherwise coated upon or encompass the brush body defined by the support plate 11, bristles 12 and projection 13 in whole or in part.

Figure 3:
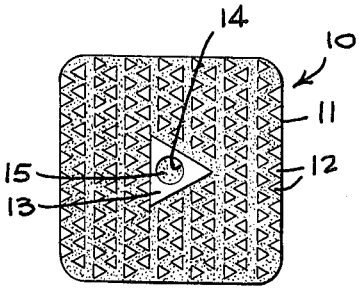
FIG. 3 is a view taken on the line 3—3 of FIG. 1.

In FIG. 3, there is shown a plan view of the dental care device 10, wherein in may be seen that in plan form, the support body 11 is square having rounded corners, and is provided with rows of bristles 12 of triangular cross-section. The projection 13 in this case extending from the middle of the support body 11 may be seen, with the material 15 in the hollow 14 thereof.

The dental care device shown in FIGS. 1–3 may be utilized by inserting it entirely within the mouth of a human, and then chewed, particularly by effecting chewing on the projection 13, while it extends between the teeth, the ends of the bristles 12, thereby engaging the side surfaces of the teeth perpendicularly. While this dental care device is effective and efficient, and furthermore, is attractive because the material 15 is a palatable mass of material which is sweet tasting, i.e., as a candy, but is of a composition which is non-caries producing.

Figure 4:
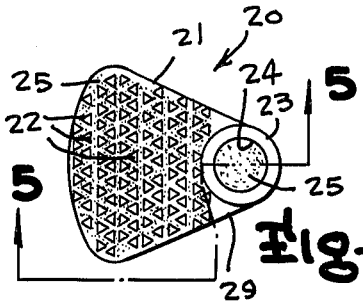
FIG. 4 is a plan view, similiar to FIG. 3, of a preferred embodiment of the present invention.
Figure 5A:
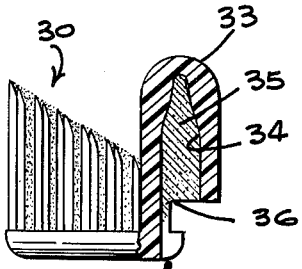
FIG. 5A is a cross-sectional view, with parts broken away, of an alternate embodiment of a dental care device.
Figure 5B:
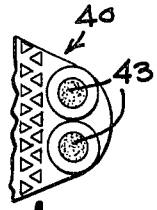
FIG. 5B is a plan view, with parts broken away, of another dental care device.
Figure 5:
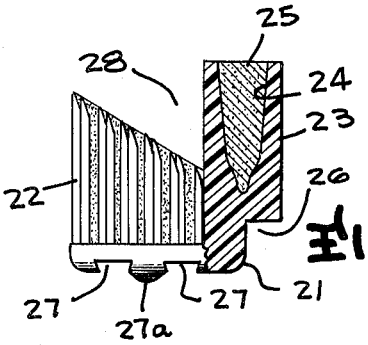
FIG. 5 is a view taken on the line 5—5 of FIG. 4.
Figure 6:
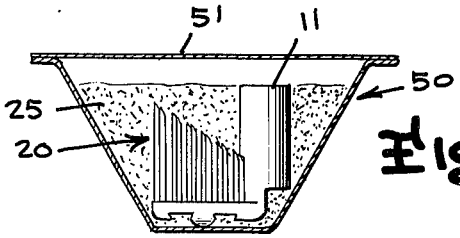
FIG. 6 is a cross-sectional view of a container with the dental care device of FIGS. 4 and 5 therein.

A preferred embodiment of the present invention is disclosed in FIGS. 4–6. Referring now to FIG. 4, there is shown a dental care device 20 having a brush body including a generally flat support body 21 of generally triangular plan form, having rounded corners, and having bristles 22 of triangular cross-section arranged in rows. Also on the support body 21 is an upstanding projection 23, in this case situated adjacent the edge of the support body, having a hollow 24 therein which may be filled with material 25 of the above-noted characteristics. The material 25 may also be contained in the spaces between the bristles 22, or may partly or entirely envelope the brush body comprised of the support body 21, bristles 22 and projection 23. The encapsulation, if present, may completely encompass not only the support body 21 and bristles 22, but the projection 23, which is round in cross-section. The projection 23 in the embodiment of the invention in FIGS. 4, 5 and 6, is at a corner of the support body 21, and as is shown in FIG. 5, extends from the same side of support body 21 as do the bristles 22.

Beneath the hollow 24, a portion 26 of the projection 23 is removed, so as to provide a stepped configuration. Extending across the lower side of the support body 21, opposite the bristles 22, are grooves 27 and ridges 27a or other elevations. The bristles 22 have rounded ends, and the bristles which are closest to the projection 23 are substantially shorter than projection 23, the height of the bristles increasing uniformly with the distance of the bristles from the projection 23. There is thereby provided a wedge-shaped opening 28.

As shown in FIGS. 4 and 5, a length of dental floss 29 may be attached at any suitable place to the dental care device 20.

Referring now to FIG. 5A, there is shown in cross-section a further modification of the dental care device, designated 30, and having a projection 33 with a hollow 34 therein and a mass of palatable material 35 in the hollow 34. The opening into the hollow 34 is opposite that of the embodiment shown in FIGS. 4 and 5, in that the opening 36 is at the bottom or lower portion of the projection 33, remote from the upper or outer end of projection 33 that now is rounded for a more pleasant feel.

FIG. 5B discloses a still further embodiment of a dental care device, designated 40, in which the projection part as a whole consists of two (or more) projections 43, extending upwardly from a support plate 41, the dental care device 40 otherwise being the same as the dental care device 20.

The projections, such as projection 23, are hollow, and are of pliable, resilient material, and provides and effect like that of chewing gum. The projection 23 prevents chewing perpendicularly to the bristles 22 so that the bristles 22 can be relatively rigid, which is necessary for proper cleaning. As the projection 23 is open only at one side, it can be vacuum sucked and thereby satisfy the need for sucking, this sucking action also drawing out the material 25. Preferably the projection lies at the border or edge of the support body 21, so the entire dental care device 20 can be kept relatively and pleasantly small.

The purpose of the stepped portion 26 is for better gripping by the teeth. That is also the purpose of the grooves and ridges 27, or other unevennesses, elevations.

The material 25 in the projection 23 may be rigid, or not, and may have a relatively strong flavor, thereby resulting in a continuous release of slight amounts of flavor during chewing. In addition, the projection 23 may be filled with medicaments, such as an organic fluoride, that otherwise would interact with the candy composition round the bristles, because it is chemically unstable.

The present invention dental care device is capable of being readily injection molded in spite of its thin bristles, so that it may be made in one piece. A suitable material is a polyester elastomer. It is also possible, however, to make a dental care device 20, etc., by securing bristles separately therein, in known manner, and in that case, the support body 21, the bristles 22 and the projection 23 may be made of different materials. The materials can be selected, depending upon the desired characteristics of the various parts of the dental care device. The dental care device is made sufficiently small that it may be readily placed within the mouth, is relatively soft, pliable and resilient, particularly the bristles 22, which bristles are, however, still sufficiently rigid to enable a suitable cleansing action in the manner to be hereinafter described. In addition, the material of the dental care device should be tough and hard, so that it does not disintegrate in the mouth during chewing.

Preferably the brush body 21 comprises radiopaque material so that in the event of aspiration into the respiratory tract, its position can be readily determined by X-rays. This radiopaque material may consist of salts containing heavy metals, such as iodine, which can be added as a powder to the starting material for making the dental care device, but also may be a piece of metal accommodated in the brush body.

The material for the brush body can also be filled with polishing material such as calcium carbonate or glass fibers to roughen the surface of the bristles 22 for a superior polishing effect on the teeth. In addition, a rough surface on the bristles 22 may be achieved by the use of a mold which has been roughened for instance by etching or by the use of a material that has a porous, foamlike consistency. In this case, any polishing materials which may be present in the material 25 may be omitted.

It is within the contemplations of the present invention that the dental care device may be made of material which slowly disolves in water, which is advantageous in case the brush body should accidentally be swallowed.

The brush body may have flavors included in it, and may be colored, as desired.

In addition to the generally triangular plan form shown in FIG. 4, which is the preferred form, the support body 21 may be rectangular, square, oval or circular. However, the preferred form is a body which has a corner, preferably a triangular body, with the projection located at the corner, and projecting above all of the bristles 22, as shown in FIG. 5. The projection 23 is preferably round, having a diameter approximating the size of a cigarette mouth piece. The bristles 22 are arranged in rows, for ease in injection molding. The characteristics of the bristles 22 may be varied, within the spirit of the invention, so as to be longer or shorter, harder or softer, thinner or thicker, although the preferred characteristics of bristles 22 have been indicated above. A triangular cross-sectional configuration gives a better cleaning effect (scraping action) than the round cross-sectional configuration of the bristles of conventional toothbrushes.

The material 25, also referred to as a palatable mass, coats or surrounds the brush body formed by support body 21, bristles 22 and projection 23 in full or in part, and is of non-caries producing candy components, and may have, in addition, dentifrice components which are substantially free of adhesive material, so that the mass or portions of it does not cling to the teeth of the user. As will be appreciated, the palatable mass may be attractively flavored, so as to encourage the use of dental care device 20.

Known dentifrice components are, for example, abrasives and polishing agents, such as calcium carbonate, dicalcium phosphate dihydrate, anhydrous dicalcium phosphate, tricalcium phosphate, calcium pyrophosphate, aluminium hydroxide, insoluble sodium methaphosphate, hydrated silicon dioxide and globules of polymethacrylate; detergent such as potassium or sodium palmitate and stearate, sodium lauryl sulfate, sodium-n-lauroyl sarcosinate; flavours and sweeteners such as peppermint oil, oil of cloves, eucalyptus oil, aniseed, lavender, saccharin, chloroform; anti-drying agents such as glycerine, sorbitol 70%; binders such as tragacanth, sodium carragenate, sodium carboxymethyl cellulose, hydroxyl cellulose; bleaching agents such as sodium perborate, magnesium peroxide, hydrogen peroxide-urea compounds and stabilized hydrogen peroxides; and therapeutics such as 1. caries inhibitors; fluorides, hexachlorophene, tyrothricine, dichlorophenylmethane, exzymes like lactoperoxidase, remineralising ingredients like primair orthophosphate and trimetaphosphate with complex calcium. 2. dentalplaque-formation inhibitors: chlorohexidine digluconate; 3. antiflogistics: vitamin A; 4. agents for treating sensitive tooth neck: potassium nitrate; silver nitrate and zinc chloride, organic iodine compounds, calcium hydroxide, fluorides, formaldehyde, strontium chloride.

The proportions are determined according to the desired activity, taste and consistency of the solid mass of physiologically acceptable materials. Preferably the proportion of detergents is limited so as to avoid undue foam formation as takes place with normal tooth brushing.

Caries producing components, such as sugars, are preferably absent or present in relatively minor, insignificant quantities only. An elastic marshmallow-like composition on the basis of, for example, gelatine and sorbitol behaves most pleasantly in the mouth.

In a preferred embodiment of the invention the palatable mass contains dental plaque coloring agents, such as erytrosine and fuchsine, so that the user can see from the disappearance of the red color on the teeth that he has chewed the brush body long enough.

The brush body can be provided with the solid palatable envelope in many ways. Indeed, the manner in which this is done is not critical. One efficient way of applying the envelope is immersing the brush body in the still liquid or pasty mass of the envelope components and subsequently allowing the mass around the brush body to dry and harden. It is also possible for the mass, when not yet in the solid state, to be poured over the brush body. If there is provided a projection having an open cavity therein, the non-solidified mass can be injected into it. It is possible, and preferable, to apply masses of different compositions. Preferably the bristle members are coated with a mass principally containing toothpaste components, such as polishing agents, the cavity in the projection, if present, is filled with a mass especially containing a large amount of flavor, and the whole is surrounded by, or has a basis of a gelatinous composition which in addition to flavors mainly contains gelatine and sugar substitutes, such as sorbitol, mannitol and xylitol.

The outer shape of the dental care device according to the invention is not critical. For reasons of manufacturing technique it is sometimes desirable that the shape corresponds to the shape of the brush body, but this is of course not essential.

Preferably the palatable mass is transparent, so that the user can see the brush body and is not faced with surprises. A colored appearance will enhance the attractiveness for the user. A non-transparent mass, whether colored or not, is also possible however.

Referring now to FIG. 6, there is disclosed a preferred manner of packing the dental care device 20 (or the dental care device 30 or 40). There is disclosed a transparent container 50 of synthetic plastic material, having a dental care device 20 (or 30 or 40) enclosed therein. The container 50 is of generally truncated pyramidal shape, having an open end which is closed by a foil 51, which may be aluminum. The palatable mass 25 may be introduced into the container 50 in liquid or paste condition, either before or after the introduction of the brush body (made up of the support body 21, bristles 22, projection 23). The palatable mass 25 may harden in the container 50. A plurality of the containers 50 may be provided as a set in known manner.

In addition, it is possible that the brush body and the palatable mass 25, forming the dental care device 20, can be distributed without any packing, where the palatable mass 25 is sufficiently hard and non-tacky.

In addition, it is contemplated that the brush body could be provided without a palatable mass in association with it and could be used, for example, in a container in an edible product such as yogurt or pudding. As thus packaged, it would be possible to clean the teeth with the brush body immediately after the yogurt, pudding, or other edible material is consumed.

Figure 7:
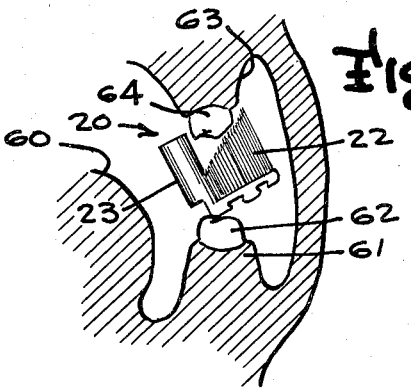
FIGS. 7 and 8 show the dental care device of FIGS. 4 and 5 in use, in the mouth of a human.
Figure 8:
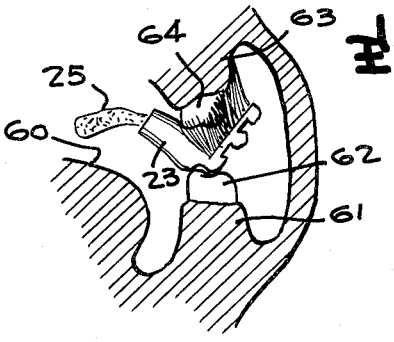

Referring now to FIG. 7, there is shown a partial cross-sectional view, somewhat diagramatic, of a human mouth, including tongue 60, lower gum 61, lower molar 62, upper gum 63, upper molar 64 and cheek 65. A dental care device 20 in accordance with the present invention is shown in the mouth, between the upper molars 64 and lower molars 62. When the projection 23 is situated adjacent the edge of the support body or in a corner thereof it becomes possible to chew on the projection in combination with the support body. The projection will be engaged in a chewing action by the molars 64 and 62, as shown in FIG. 8, the ends of the bristles 22 will be automatically forced against the side surfaces of upper molar 64, as well as the bottom surfaces thereof, entering into spaces beteen molars, as well as spaces between cusps, achieving a very effective cleaning of the teeth, that is to say removal of bacterial plaque in the hidden places, this cleaning being in accordance with the popular conventional Bass-method of toothbrushing where the bristle ends are engaging the side surfaces of the teeth at an angle of 45 degrees. In this manner of operation, the upper molars 64 are guided into the wedge 28, and there is no perpendicular chewing of the bristles 22, so as to flatten them. As will be understood, while the illustration in FIGS. 7 and 8 is of the bristles 22 engaging the upper molars 64, the lower molars may be similarly engaged, and all molars may be engaged both on their labial and lingual surfaces. In addition, the use of the present invention dental care device 20 is not limited to the cleansing of molars, but may cleanse all the teeth in the human mouth.

The stepped portion 26 provides a seat on which the molar or other tooth may engage, as shown in FIG. 8, and the grooves 27, ridges **27*a* or other unevennesses or elevations, in other positions of the device 20**, may be engaged by a tooth in order to assist in the chewing action.

In addition, if palatable mass material 25 is provided in the hollow 24 of the projection 23, when the latter is chewed, the mass 25 or a portion thereof may be expelled as a body or partially, as is illustrated in FIG. 8, to thereby assist in the cleansing, and to provide additional flavor, in a prolonged manner, during the chewing of the dental care device 20 (30, 40). This provides not only for beneficial cleaning of teeth, but also provides for an attraction due to the flavoring of the palatable mass 25.

The dental care device herein disclosed provides proper cleaning, i.e., removal of plaque in the hidden places between teeth and including the molars. The projection, which extends above the support body with its bristles is essential for the cleaning action of the device, as it is provided for chewing on and thereby automatically moving the bristles through the teeth and molars. The bristle ends are thereby automatically engaging the side surfaces of the teeth and molars, so the projection is actually a chewing member. Furthermore, the projection prevents chewing perpendicularly on the bristles and so prevents their being flattened. The projection is pliable and elastically deformable for pleasant chewing upon and perferably hollow so it can be filled with special extra flavored dentifrice masses, different from the rest of the enveloping mass.

If, preferably, the projection is situated adjacent the edge of the support body, the support body can be kept relatively small, and it becomes possible to chew on the projection in combination with the support body, eventually using a stepped portion between the projection and support body, the latter optional construction provided with grooves, ridges or other elevations, the whole for better gripping. The brushing action becomes in that case automatically in accordance with the Bass method.

If the bristles adjacent to the projection are shorter than the others, thereby a wedge is formed, the teeth and molars are more easily guided by the projection in the good position, whereby the bristle ends engage the side surfaces in accordance with Bass. Furthermore the projection can in that case be relatively short as well, even shorter than some of the bristles, so the whole device can be even smaller.

Preferred dimensions of a brush body are as follows:

Brush support body 21 aprox. 1.8×1.5×0.2 cm.

Projection 23 approx. 1.2 cm high; Diameter approx. 0.7 cm

Bristle length approx. 1.2–0.4 cm depending on their place on the support body.

It will be obvious to those skilled in the art that various changes may be make without departing from the spirit of the invention, and therefore the invention is not limited to what is shown in the drawings and described in the specification but only as indicated in the appended claims.

I claim:

1. A dental care device for insertion entirely within the mouth of a human for effecting a cleaning action by bristles on tooth surfaces by chewing comprising:

(a) a chewable brush body of non-edible pliable, material (b) said brush body comprising:

(i) a single support body, (ii) bristles extending from a surface of said support body only substantially in the same direction, and (iii) a pliable and resilient projection extending from said surface of said support body, adjacent the edge thereof, substantially in the same direction as said bristles, (c) said brush having such dimensions that it can be inserted entirely into the human mouth and manipulated within the mouth by chewing upon the pliable and resilient projection.

2. A dental care device as set forth in claim 1, wherein said support body is generally triangular in plan form.

3. A dental care device as set forth in claim 1 or 2, said support body having a corner in plan form, said projection extending from said corner of said support body.

4. A dental care device as set forth in claim 1 or 2, said support body having an outer portion thereof at an elevation above the remainder of said support body, said projection extending from said elevated portion.

5. A dental care device as set forth in claim 4, wherein said body is generally triangular in plan form, said outer portion being an apex thereof.

6. A dental care device as set forth in claim 5, and grooves provide in said body.

7. A dental care device as set forth in claim 1, wherein the bristles adjacent said projection are of reduced height in comparison to the bristles remote from said projection.

8. A dental care device as set forth in claim 1, wherein the bristles adjacent the projection are relatively short, the height of the bristles increasing substantially uniformly as the distance to the projection increases.

9. A dental care device as set forth in claim 8, wherein the projection is higher than the bristles adjacent to it.

10. A dental care device as set forth in claim 9, wherein the projection is shorter than bristles remote therefrom.

11. A dental care device as set forth in claim 1, wherein at least some of said bristles comprise abrading means.

12. A dental care device as set forth in claim 11, wherein said abrading means comprises calcium carbonate.

13. A dental care device as set forth in claim 11, wherein said abrading means comprises glass fibers.

14. A dental care device as set forth in claim 1, wherein at least some of said bristles have the surface thereof roughened.

15. A dental care device as set forth in claim 1, and at least an additional pliable and resilient projection on said support body adjacent said first mentioned projection.

16. A dental care device as set forth in claim 1, and a length of dental floss attached thereto.

17. The dental care device as set forth in claim 1, wherein said projection is hollow, and has an opening into said hollow.

18. The dental care device as set forth in claim 17, said projection having an outer end remote from said support body, said opening being remote from said outer end and extending through said support body.

19. The dental care device as set forth in claim 1, and further comprising a palatable mass of non-caries producing candy substantially free of adhesive material.

20. A dental care device as set forth in claim 1, wherein said support body is substantially flat.

* * * * *